United States Patent [19]

Holt

[11] Patent Number: 4,461,074

[45] Date of Patent: Jul. 24, 1984

[54] APPARATUS FOR ASSEMBLING ELECTRICAL CABLES TO ELECTRICAL CONNECTORS

[75] Inventor: Harley R. Holt, Forest Park, Ill.

[73] Assignee: Bunker-Ramo Corporation, Oak Brook, Ill.

[21] Appl. No.: 360,301

[22] Filed: Mar. 22, 1982

[51] Int. Cl.[3] ..... H01R 43/04

[52] U.S. Cl. ..... 29/749; 29/753; 29/760

[58] Field of Search ..... 29/749, 753, 714, 715, 29/754, 760, 566.3

[56] References Cited

U.S. PATENT DOCUMENTS 3,967,356 7/1976 Holt ..... 29/753
4,193,187 3/1980 Haller et al. ..... 29/749
4,307,504 12/1981 Davis et al. ..... 29/566.3
4,334,353 6/1982 Holt ..... 29/753

*Primary Examiner*—Carl E. Hall
*Attorney, Agent, or Firm*—C. D. Lacina

[57] ABSTRACT

Energizing a solenoid causes mechanical means to close a pair of jaws and crimp a cable in a U-shaped cable clamp mounted to a multi-contact connector positioned for termination in an electrically powered termination tool. A movable carriage carries termination means and controls activation of switch means for energizing the solenoid during a portion of its travel. The mechanical means comprise either a link block and toggle levers or bell cranks and push bars. Hold-down means are provided for temporarily holding the cable in the clamp prior to closure.

15 Claims, 5 Drawing Figures

APPARATUS FOR ASSEMBLING ELECTRICAL CABLES TO ELECTRICAL CONNECTORS

CROSS REFERENCE TO RELATED PATENT AND APPLICATIONS

This invention is used in apparatus similar to that described in U.S. Pat. No. 3,967,356, issued July 6, 1976, which patent is hereby incorporated by reference, and is generally related to an apparatus described in U.S. Pat. No. 4,334,353, issued June 15, 1982, both patents being inventions of the present applicant and assigned to the assignee of the present invention.

Background of the Invention

This invention is directed to a power tool for assembling electrical cables to an electrical connector. More particularly, the invention concerns electrically powered apparatus for crimping a cable clamp to a cable positioned for termination of the individual wires therein to a multi-contact connector.

In the electrical industry, particularly in the telecommunications industry, there is a continuing need for tools to efficiently and effectively affix multi-wire cables to multi-contact connectors and to terminate the wires to the individual connector contacts. For instance, with such well known telephone-type connectors as the Amphenol Series 57 and 157 electrical connectors, an elongated insulated body or insert is provided with a plurality of parallel slots or "pockets" on each side adapted for receiving individual contacts. The contacts may be soldered or attached by insulation displacement techniques to the individual wires of the cable.

Most telephone-type connectors include some form of cable clamp means for holding a cable to the connector itself when in service to provide strain relief for the individual wires terminated to the contacts. The above-mentioned U.S. Pat. No. 4,334,353 shows a hand-operated cable clamp closer as an attachment to an automatic insulation displacement termination tool for closing such a cable clamp prior to terminating wires to the connector contacts.

The automatic insulation displacement termination tool described in U.S. Pat. No. 3,967,356 includes a plurality of fixed guide combs arranged in pairs on each side of the connector to-be-terminated in alignment with the corresponding contacts previously "loaded" in the connector insert pockets. Appropriate pairs of individual conductors are manually positioned via the guide combs adjacent corresponding contacts where they are terminated and trimmed automatically by insertion heads. The insertion heads are carried on a carriage which is sequentially movable to predetermined positions alongside the connector contacts. Movement of the carriage and operation of the insertion heads are pneumatically controlled.

While the hand operated cable clamp closer attachment to the automatic termination tool is effective, there is still a need for a mechanism for automatically performing this function on the automatic termination tool.

A principal object of the invention is to provide a new and improved apparatus for assembling electrical cables to an electrical connector.

Another object of the invention is to provide an apparatus for assembling electrical cables to an electrical connector without the need for hand tools.

A further object of the invention is to provide a novel apparatus for quickly and effectively assembling electrical cables to electrical connectors.

A feature of the invention comprises an over-center toggle-link mechanism for temporarily holding a cable in the cable clamp of a properly positioned connector while the cable clamp is closed.

Other objects, features and advantages of the invention will be apparent from the following detailed description taken in connection with the accompanying drawings.

Summary of the Invention

The inventive apparatus includes a base having locator means for properly locating a connector, having a cable clamp, in position for termination to the individual wires of a multi-conductor cable. Jaw means are mounted on the base for movement toward and away from a properly positioned connector for closing the cable clamp and providing strain relief for the wires of the cable. Actuation means are mounted on the base for driving the jaw members in response to switch means.

More particularly, a movable carriage for carrying termination means is provided and the actuation means include a solenoid and mechanical means for controlling movement of the jaws. The switch means include a momentary contact switch, a spring biased actuator, and override means arranged to control energization of the solenoid during a limited portion of movement of the movable carriage.

The mechanical means in one embodiment includes a pair of push bars mounted for reciprocal movement on the base. The solenoid drives a gear rack which rotates a gear segment fixed to a rotatable shaft equipped with hubs and eccentric cam rollers for moving the push bars. The push bars engage a pair of pivotable bell cranks which drive the jaws for closing the cable clamp.

In another embodiment of the mechanical means the solenoid moves a link block carrier which is coupled to a pair of toggle levers through a pair of toggle push links for driving the jaws toward each other.

DETAILED DESCRIPTION OF THE INVENTION

Figure 1:
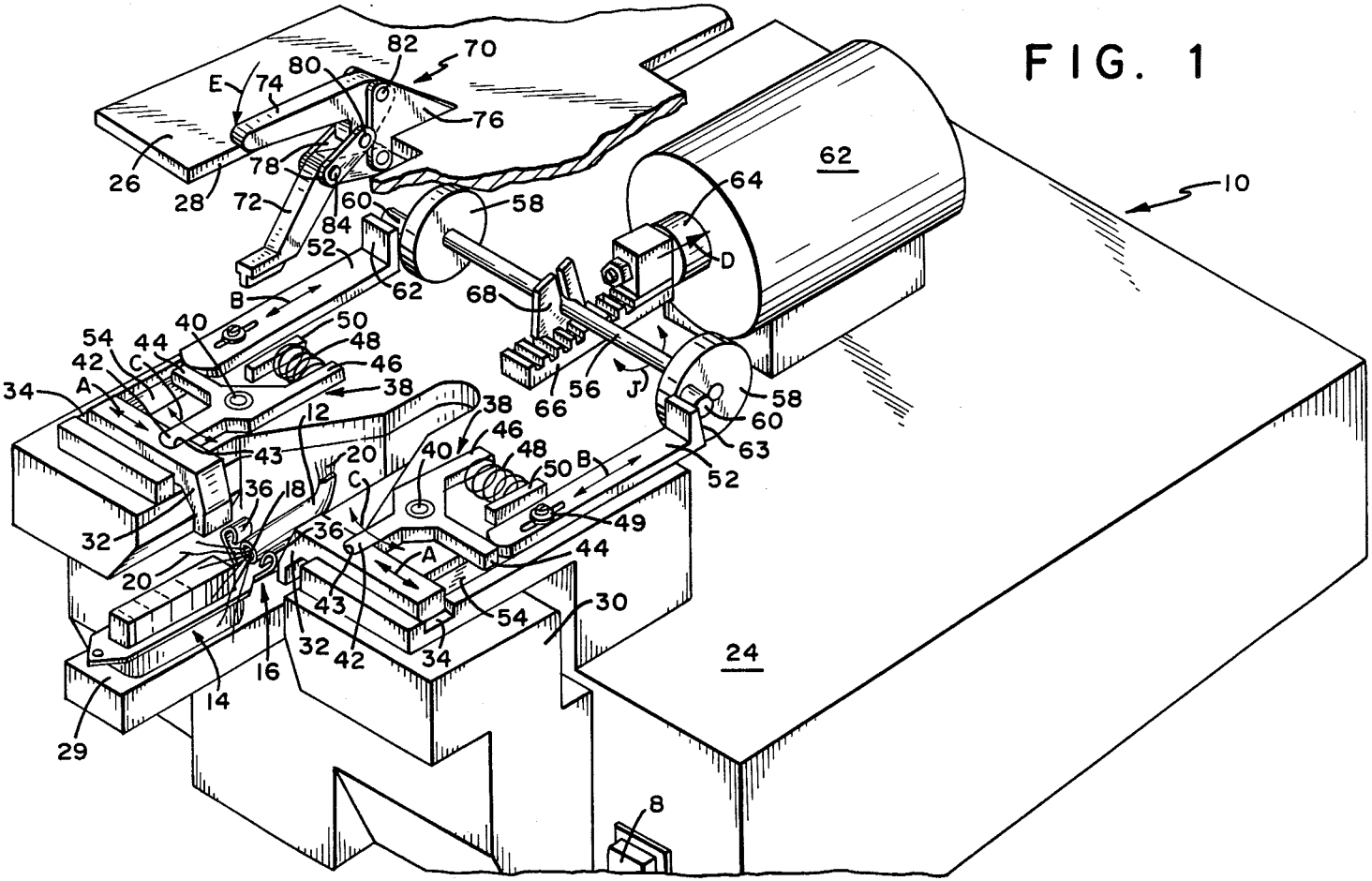
FIG. 1 is a partial perspective view of an embodiment of apparatus with one mechanical arrangement for assembling electrical cables to an electrical connector constructed in accordance with the present invention.

Referring to FIG. 1, automatic insulation displacement termination apparatus 10 is shown for assembling a multi-wire electrical cable 12 to a multi-contact electrical connector 14. The connector has a generally U-shaped cable clamp 16 mounted to it for securing the cable in position prior to termination of the individual wires 20 of the cable to the respective contacts (not shown) on each side of the connector. Cable 12 has an outer jacket 18 protectively enclosing individual wires 20. Apparatus 10 includes a base 24 and a cover plate 26 mounted to the base by means (not shown). Cover plate 26 defines a generally rectangular U-shaped opening 28 at its front edge to permit manual dressing of cable 12 in cable clamp 16.

Apparatus 10 also includes locator means 29 at its lower front for properly positioning and securely supporting connector 14 during a termination cycle. This arrangement is similar to that disclosed in the above-mentioned U.S. Pat. No. 3,967,356 where the connector is stationary and the terminating means, i.e. insertion heads or punches, are carried on a sequentially movable carriage. In the present apparatus carriage means include a carriage 30, sequentially movable in a front-to-rear direction along the length of connector 14, which carries insertion heads (not shown) to predetermined positions along the connector where wire insertion and termination operations are performed in a well-known manner (also not shown). Movement of the carriage and operation of the termination means are fully described in the U.S. Pat. No. 3,967,356. A switch "S" is shown on the front of base 24 for initiating a termination cycle. This results in carriage 30 being driven to the position shown in the Figures. Other structural details and operations of the apparatus are fully described in the above U.S. Pat. No. 3,967,356.

Jaw means comprising a pair of jaws 32 are mounted on the base by means (not shown) for reciprocal (closing and opening) sliding movement within rectangular tracks 34 in the directions of arrows A toward and away from connector 14. The jaws squeeze a pair of deformable ears 36 on the U-shaped cable clamp causing it to grip the cable to provide strain relief for the as-yet-unterminated individual wires of the cable.

Two three-arm bell cranks 38, are pivotally mounted for movement about pivots 40 on the base. Each bell crank has a drive arm 42 engaging a respective rounded recess 43 in the rear side of its associated jaw 32. An actuate arm 44 on each bell crank extends perpendicular to drive arm 42 and engages the forward end of an associated push bar 52. The third arms are release arms 46 which engage respective compression springs 48 captivated between the release arms and flanges 50 on the base.

Push bars 52 are slidably mounted for reciprocal movement within rectangular channels 54 on the base perpendicular to tracks 34 in which the jaws move. Double-headed arrows B indicate the movement direction of the push bars. Travel of the push bars is constrained by a screw, washer and slot arrangement indicated at 49 and the edges of flanges 50 and associated sides of the push bars. The push bars act against actuate arms 44 of the bell cranks causing them to pivot toward each other along the direction lines indicated by double-headed arrows C. Drive arms 42, in turn, drive the jaws toward each other to close the ears of the cable clamp. A pivotable shaft 56 has a wheel-like hub 58 on each end with off center or eccentric cam rollers 60 for driving cam ears 63 on the rear ends of the push bars.

Shaft 56 is pivoted by power means in the form of a solenoid 62 having an armature 64 rearwardly movable in the direction of arrow D in response to energization of the solenoid by switch means (not shown). A gear rack 66 is fixed to and movable with the armature to pivot a gear segment 68 secured to shaft 56. Thus, when solenoid 62 is energized by the switch means, gear rack 66 moves rearwardly, pivoting shaft 56 in a counterclockwise direction and causing cam rollers 60 to bear against cam ears 63 on push bars 52. The pivotal movement of shaft 56 is indicated by double-headed arrow J. The arrangement including bell cranks 38, push bars 52, hubs 58, cam rollers 60, shaft 56, gear segment 68 and gear rack 66, comprise mechanical means. Together with solenoid 62, armature 64 and miscellaneous unspecified hardware, they are referred to an actuation means.

As mentioned above, push bars 52 move forwardly against actuate arms 44 of the bell cranks causing drive arms 42 to move jaws 32 toward each other and squeeze ears 36 of cable clamp 16 to grip cable 12.

Solenoid 62 is energized for a predetermined minimum time whereupon it is deenergized and armature 64 is no longer urged in direction D. At this point, the compression of springs 48 force release arms 46 of the bell cranks in a counterclockwise direction, moving jaws 32 apart. Drive arms 44 force push bars 52 rearwardly, forcing reverse rotation of hubs 58 and gear segment 68 and helping to return the armature to its rest position.

It should be noted that suitable bearing supports are to be provided on base 24 for rotatable shaft 56 and for slidable gear rack 66. These supports may be conventional and have not been shown to avoid needlessly complicating the drawings.

A feature of the invention includes hold-down means on cover plate 26 for temporarily holding cable 12 in the cable clamp of a connector positioned for termination during crimping of the clamp. More particularly, the holding means comprise an over center toggle link mechanism 70 including a pivot arm 72 for pressing the cable into the cable clamp, a pivotable handle 74 for operating the mechanism, a pair of toggle links 78 connected between pivot arm 72 and handle 74 and a clevis block 76 fixed to cover plate 26 (and to base 24 by means not shown) and supporting pivot arm 72 and handle 74. Upon depression of handle 74 in the direction of arrow E, pivot point 80 moves over-center of a line between pivot points 82 and 84 thereby moving pivot arm 72 in its down position and pressing the cable into the cable clamp.

Figure 2:
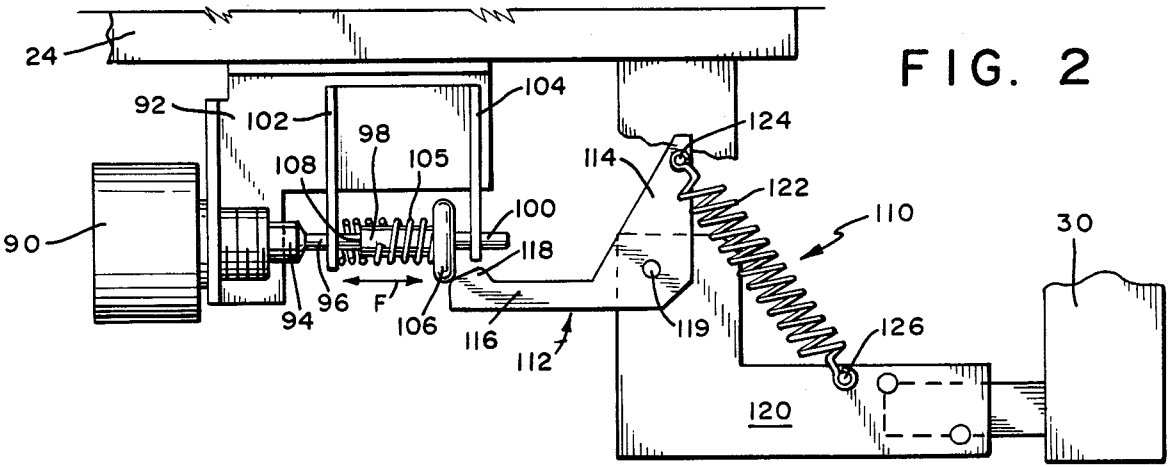
FIGS. 2–4 are enlarged fragmentary side elevational views showing the switch means (hidden in FIG. 1).
Figure 3:
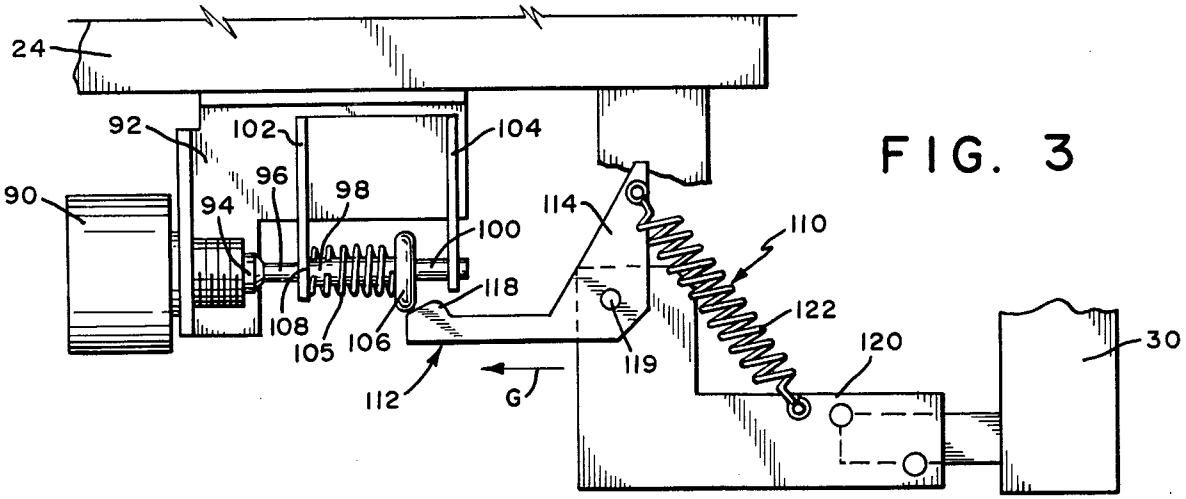
Figure 4:
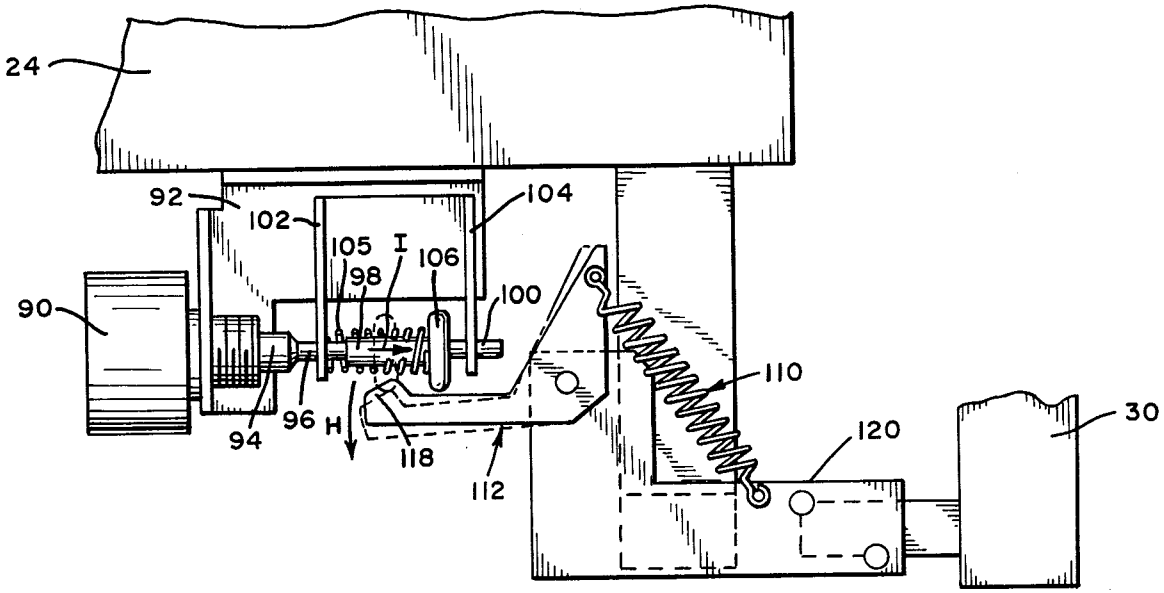

Referring to FIGS. 2–4, the switch means for energizing solenoid 62 for a predetermined time during movement of the carriage to cause the jaws to close the cable clamp are shown. (None of these elements are visible in FIGS. 1 or 5). A momentary contact push-button switch 90 is supported on a frame member 92 mounted on the underside of base 24. The switch has a conventional rearwardly biased push button 94 engageable by a spring biased actuator 98 having a rear rod portion 96, a front rod portion 100 and a large annular spool 106 near one end. The actual electrical switch mechanism is not illustrated. Rod portions 96 and 100 extend through apertures in spaced flanges 102 and 104, respectively, on frame member 92. In this manner, actuator 98 is movable between flanges 102, 104 in the directions of double-headed arrow F. A compression spring 105 is captivated between flange 102 and spool 106. A shoulder 108 is formed on the actuator to the left of the end of rod portion 96. Thus, as shown in FIG. 2, spool 106 of actuator 98 is spaced from flange 104, and shoulder 108 is spaced from flange 102, with push button 94 in its inoperative position.

The switch means also include override means 110 comprising an L-shaped lever 112 having an upwardly extending arm 114 and a leftwardly extending arm 116. Lever 112 is mounted on a pivot 119 to a member 120 affixed to and movable with carriage 30. Lever 112 also has a cam 118 engageable with spool 106. The manner of mounting these various components is not of particular significance insofar as the invention is considered and any well-known means may be employed. Lever 112 is biased by a tension spring 122 coupled between arm 114 (at 124) and member 120 (at 126).

FIGS. 2 and 4 show the switch means in its inoperative condition whereas FIG. 3 indicates its operative condition. Initially, a connector is loaded or positioned on locator means 29 (FIGS. 1 and 5), a cable dressed into position in U-shaped cable clamp 16, handle 74 depressed to hold the cable in place and carriage 30 moved to its full rearward position (to the left in FIGS. 2–4) responsive to operation of switch "S". Member 120 carries lever 112 to the left responsive to movement of the carriage. Cam 118 engages spool 106, driving actuator 98 to the left and causing rear rod portion 96 to move the push button to operate switch 90 which energizes the solenoid.

The actual wiring of the solenoid and switch 90 is not illustrated to avoid encumbering the description with unnecessary detail. The electrical circuit is quite elementary.

It will be noted that the spool is moved against the force of captivated compression spring 105 until shoulder 108 of the actuator abuts flange 102. It is desirable to energize the solenoid for only a time sufficient to assure full closure of the cable clamp. The provision of momentary contact push button switch 90 and the proper arrangement of the actuator, spool and face of the cam is generally sufficient to assure complete closure of the jaws. However, in certain situations it may be desired to energize the solenoid for a longer minimum time period and conventional means may be provided for assuring a minimum energization time once the solenoid is actuated. This may conveniently take the form of an intermediate timing circuit to control deenergization of the solenoid responsive to actuation of the push button switch. For example, switch 90 would close a power circuit to the solenoid through a time delay relay which would energize the solenoid for a predetermined time and then release. The apparatus would then be ready for a subsequent cable clamp crimping operation upon closure of switch 90. There are many such well-known circuits, none being illustrated since the circuit per se is not part of the present invention.

With the actuator stopped, spring 122 permits lever 112 to move about pivot 119 and allows cam 118 to override spool 106, whereupon spring 105 drives actuator 98 to the right to the position illustrated in FIG. 4. Push button 94 returns to its inoperative position and switch 90 is deactivated. During further termination operations, the carriage is moved to carry the termination heads (not shown) along the connector and in so doing member 120 moves to the right. L shaped lever 112 overrides spool 106 in the opposite direction and returns to its initial position illustrated in FIG. 2. Switch 90 is not activated during this movement.

The automatic deenergization of solenoid 62 by the override means permits an operator to leave the machine before completion of a full cycle of operation without the solenoid being continuously energized. Without the feature, a much larger solenoid would be required to handle the possibility of continuous operation.

Figure 5:
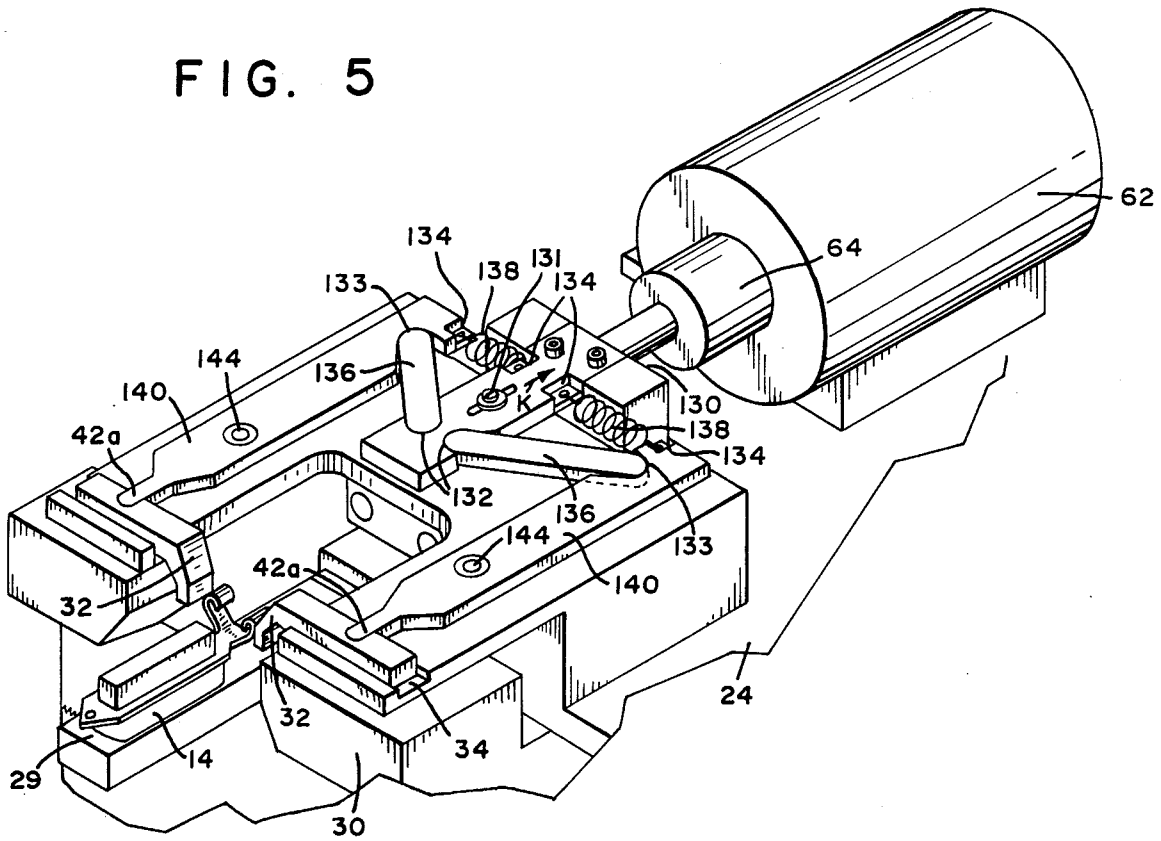
FIG. 5 is a partial perspective view of a different embodiment of the apparatus of the invention with another mechanical arrangement.

FIG. 5 illustrates another embodiment of the mechanical means for translating movement of the solenoid armature to movement of the jaws of the cable clamp closer. Specifically, solenoid 62 has its armature 64 connected to a link block 130 which is adapted for reciprocal sliding movement on base 24. As will be apparent to those skilled in the art, many arrangements may be used to enable this sliding movement. As shown at 131, a screw, washer and slot arrangement readily permits this kind of movement of the link block with respect to the base in the direction of the slot. The link block includes a pair of oppositely disposed and contoured recesses 132 designed for driving engagement with a pair of toggle push links 136. The other ends of the toggle push links engage a pair of similarly contoured recesses 133 in respective ones of toggle levers 140. The toggle levers are pivotally mounted to base 24 via pivots 144. The toggle levers terminate in drive arms **42*a* which engage jaws 32 in substantially the same way as drive arms 42 of FIG. 1. The other ends of the toggle levers are connected via springs 138** to the link block. The respective ends of the toggle levers and the appropriate portions of the link block are undercut to keep the springs below the height of the link block, toggle push links and toggle levers.

The operation of the device is straightforward. Upon energization of solenoid 62, armature 64 moves link block 130 in the direction of arrow K causing the toggle push links to assume a more nearly perpendicular position with respect to the link block. In so doing, the toggle push links force the toggle levers to pivot outwardly about pivots 144 which forces drive arms **42*a* to move jaws 32 together and close the cable clamp. During this movement springs 138 are extended. Upon deenergization of the solenoid, springs 138 pull toggle levers 140 back to their original position, simultaneously opening jaws 32, and through toggle push links 136, returning link block 130 to its rest position. A stop (not shown) for link block 130 is provided on base 24** to limit the return movement. Alternatively the stop may be a part of the armature of the solenoid, the arrangement being a matter of choice. It will be understood that all other aspects of the apparatus are as described above.

What is claimed is:

1. Apparatus for assembling electrical cables to an electrical connector having a cable clamp for securing a multi-wire cable in position with its individual wires terminated to individual contacts on the connector, comprising:

a base;

locator means on said base for securing a connector in position to receive an electrical cable;

carriage means movably mounted on said base for positioning termination means along the length of the connector;

jaw means mounted on said base for movement toward and away from a properly positioned connector for closing the cable clamp thereon to provide strain relief for said individual wires;

actuation means mounted on said base for driving said jaw means; and switch means coupled to said actuation means for commencing operation of said actuation means, said switch means including a momentary contact switch; a spring biased actuator for said switch; and override means for maintaining said switch closed during a limited portion of travel of said carriage means.

2. The apparatus of claim 1 wherein said jaw means include a pair of jaws mounted for reciprocal closing and opening movement on said base toward and away from said cable clamp.

3. The apparatus of claim 2 further including;

hold-down means mounted to said base for temporarily securing said cable in said cable clamp.

4. The apparatus of claim 3 wherein said actuation means includes;

a solenoid having an armature; and mechanical means coupling said armature to said jaws.

5. The apparatus of claim 4 wherein said carriage means activates said actuation means for energizing said solenoid.

6. The apparatus of claim 5 wherein said override means includes a spring-biased cam lever coupled to said carriage means for operatively engaging said switch actuator only during said limited portion of travel.

7. The apparatus of claim 6 wherein said mechanical means includes:

a pair of push bars, each having one end coupled to said armature; and a pair of bell cranks coupled between the other ends of said push bars and said jaws.

8. The apparatus of claim 7 wherein said mechanical means further include a gear rack coupled to said armature;

a gear segment engaging said gear rack;

a pivotable shaft coupled to said gear segment; and a pair of drive hubs on each end of said shaft engaging said one end of said push bars.

9. The apparatus of claim 8 wherein said bell cranks are pivotably mounted and are in direct engagement with said other ends of said push bars, said bell cranks being spring biased for returning said jaws to their fully open position and said push bars to their initial positions upon deenergization of said solenoid.

10. The apparatus of claim 6 wherein said mechanical means includes;

a link block connected to said armature;

a pair of toggle push links each having one end engaging said link block; and a pair of pivotably mounted toggle levers directly engaging said jaws and the other ends of said push links.

11. The apparatus of claim 10 wherein said link block and said toggle levers define recesses, each said toggle push link engaging a recess in a respective toggle lever and a respective recess in said link block for transmitting motion from one to the other.

12. The apparatus of claim 11 further including spring bias means coupled between said link block and said toggle levers for returning said jaws to their open positions upon deenergization of said solenoid.

13. Apparatus for assembling electrical cables to an electrical connector having a U-shaped cable clamp for securing a multi-wire cable in position with its individual wires terminated to individual contacts on the connector comprising:

a base;

locator means on said base for securing a connector in position to receive an electrical cable;

hold down means for temporarily retaining said cable between the open ends of said U-shaped cable clamp;

a pair of jaws mounted on said base for movement toward and away from said cable clamp for squeezing the open ends of said cable clamp to grip said cable and provide strain relief for said individual wires;

a solenoid, including an armature, mounted on said base;

mechanical means interconnecting said armature and said jaws for driving said jaws in response to movement of said armature; and switch means for energizing said solenoid, said switch means comprising a momentary contact switch; a spring biased actuator for said switch; and a spring biased cam lever coupled to said carriage for engaging said actuator only during a limited portion of the travel of said carriage.

14. The apparatus of claim 13, further including;

termination means for terminating said individual wires to said individual contacts of said connector, and a carriage movably mounted on said base for travel in a defined path alongside a properly positioned connector, said carriage carrying said termination means to said individual wires and activating said switch means for energizing said solenoid.

15. Apparatus for assembling electrical cables to an electrical connector having a U-shaped cable clamp for securing a multi-wire cable in position with its individual wires terminated to individual contacts on the connector comprising:

a base;

locator means on said base for securing a connector in position to receive an electrical cable;

a pair of jaws mounted on said base for movement toward and away from a properly positioned connector for squeezing the cable clamp to grip the cable and provide strain relief for said individual wires;

hold down means mounted on said base for temporarily securing said electrical cable in the open ends of said cable clamp;

a solenoid, having an armature, mounted to said base;

mechanical means coupled between said armature and said jaws for controlling movement of said jaws in response to energization of said solenoid;

termination means for terminating individual wires in said cable to individual contacts of said connector;

a carriage arranged for movement alongside said connector for carrying said termination means;

a momentary contact switch for controlling energization of said solenoid;

a spring biased actuator for said switch;

a spring biased cam lever coupled to said carriage for engaging said actuator only during a limited portion of the travel of said carriage;

said mechanical means including:

a link block connected to said armature;

a pair of toggle push links each having one end engaging said link block; and a pair of pivotably mounted toggle levers directly engaging said jaws and the other ends of said push links; and a pair of springs connected between said link block and said toggle levers for returning said jaws to their open positions upon deenergization of said solenoid.

* * * * *

UNITED STATES PATENT AND TRADEMARK OFFICE

CERTIFICATE OF CORRECTION

PATENT NO. : 4,461,074

DATED : July 24, 1984

INVENTOR(S) : Harley R. Holt

It is certified that error appears in the above—identified patent and that said Letters Patent is hereby corrected as shown below:

On the front information sheet of the Patent:

At [73] Assignee, change "Bunker Ramo Corporation, Oak Brook, Ill." to read - - Allied Corporation, Morris Township, Morris County, N.J. - -.

Signed and Sealed this

*Twenty-second* Day of *January 1985*

[SEAL]

*Attest:*

DONALD J. QUIGG

*Attesting Officer* *Acting Commissioner of Patents and Trademarks*